US006955525B2

(12) United States Patent
Liang

(10) Patent No.: US 6,955,525 B2
(45) Date of Patent: Oct. 18, 2005

(54) COOLING SYSTEM FOR AN OUTER WALL OF A TURBINE BLADE

(75) Inventor: George Liang, Palm City, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 122 days.

(21) Appl. No.: 10/637,479

(22) Filed: Aug. 8, 2003

(65) Prior Publication Data

US 2005/0031452 A1 Feb. 10, 2005

(51) Int. Cl.[7] ..... F01D 5/18
(52) U.S. Cl. ..... 416/97 R
(58) Field of Search ..... 415/115; 416/95, 416/96 R, 97 R

(56) References Cited

U.S. PATENT DOCUMENTS

| | | | | |
|---|---|---|---|---|
| 3,635,587 | A | | 1/1972 | Giesman et al. |
| 3,672,787 | A | * | 6/1972 | Thorstenson ..... 416/97 R |
| 3,706,508 | A | | 12/1972 | Moskowitz et al. |
| 3,806,274 | A | | 4/1974 | Moore |
| 3,849,025 | A | | 11/1974 | Grondahl |
| 4,293,275 | A | | 10/1981 | Kobayashi et al. |
| 4,407,632 | A | | 10/1983 | Liang |
| 4,767,268 | A | | 8/1988 | Auxier et al. |
| 5,704,763 | A | | 1/1998 | Lee |
| 5,993,156 | A | | 11/1999 | Bailly et al. |
| 6,331,098 | B1 | | 12/2001 | Lee |

FOREIGN PATENT DOCUMENTS

| | | | |
|---|---|---|---|
| EP | 0845580 | A2 | 6/1998 |
| EP | 0887515 | A1 | 12/1998 |
| JP | 59160002 | A | 9/1984 |
| JP | 11072003 | A | 3/1999 |
| JP | 11280404 | A | 10/1999 |
| WO | WO01/98634 | A1 | 12/2001 |

* cited by examiner

*Primary Examiner*—Edward K. Look
*Assistant Examiner*—Richard A. Edgar

(57) ABSTRACT

A turbine blade for a turbine engine having a cooling system in at least an outer wall. The cooling system in at least the outer wall formed from at least a first plurality of parallel cavities intersected by a second plurality of parallel cavities positioned in a nonparallel position relative to the first plurality of parallel cavities. In at least one embodiment, the second plurality of parallel cavities may include an alternating configuration of cavities, such that a first cavity may be positioned proximate to an inner surface of the outer wall and a second cavity adjacent to the first cavity is positioned proximate to the outer surface of the outer wall. The first cavity may also be offset from the second cavity to form a spiral gas flow path. The cooling system in the outer wall of the turbine blade may form a spiral flow path.

21 Claims, 4 Drawing Sheets

COOLING SYSTEM FOR AN OUTER WALL OF A TURBINE BLADE

FIELD OF THE INVENTION

This invention is directed generally to turbine blades, and more particularly to hollow turbine blades having cooling channels for passing fluids, such as air, to cool the blades.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion at one end and an elongated portion forming a blade that extends outwardly from a platform coupled to the root portion at an opposite end of the turbine blade. The blade is ordinarily composed of a tip opposite the root section, a leading edge, and a trailing edge. The inner aspects of most turbine blades typically contain an intricate maze of cooling channels forming a cooling system. The cooling channels in the blades receive air from the compressor of the turbine engine and pass the air through the blade. The cooling channels often include multiple flow paths that are designed to maintain all aspects of the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade.

Operation of a turbine engine results is high stresses being generated in numerous areas of a turbine blade. Some turbine blades have outer walls formed from one or more walls. Typically, cooling gases flow through inner aspects of the turbine blade and are expelled from the blade a plurality of orifices in the trailing edge of a blade. In some turbine blades, the cooling gases also flow through one or more cavities located in an outer wall of a turbine blade. However, uneven heating in the inner and outer walls of turbine blades still often exists. Thus, a need exists for a turbine blade that effectively dissipates heat in a turbine blade.

SUMMARY OF THE INVENTION

This invention relates to a turbine blade capable of being used in turbine engines and having a cooling system including, at least, a plurality of cavities positioned in an outer wall of the turbine blade forming a plurality of spiral flow paths. The turbine blade may be formed from a generally elongated blade and a root coupled to the blade. The blade may have an outside surface configured to be operable in a turbine engine and may include a leading edge, a trailing edge, a tip at a first end, and one or more cavities forming the cooling system. The root may be coupled to the blade at an end generally opposite the first end for supporting the blade and for coupling the blade to a disc.

The cooling system may also include a plurality of cavities for producing a spiral flow of fluids through the outer wall forming the turbine blade. The plurality of cavities may be formed from a first plurality of substantially parallel cavities contained in the outer wall. In at least one embodiment, the first plurality of cavities may be positioned substantially parallel to an outer surface of the outer wall of the blade. The first plurality of cavities may also be generally orthogonal to a longitudinal axis of the turbine blade. The cooling system may also include a second plurality of substantially parallel cavities that are nonparallel to the first plurality of cavities and intersect with the first plurality of parallel cavities. In at least one embodiment, the second plurality of parallel cavities may be generally orthogonal to the first plurality of parallel cavities.

In at least one embodiment, the second plurality of cavities may include at least some cavities positioned proximate to an outer surface of the outer wall, referred to as outer surface sections, and at least some cavities positioned proximate to an inner surface of the outer wall, referred to as inner surface sections. The plurality of outer surface sections and the plurality of inner surface sections may be positioned in an alternating configuration relative to each other. Thus, an outer surface section may be positioned immediately downstream or upstream, or both, relative to an inner surface section. In at least one embodiment, the plurality of outer surface sections may be offset relative to the inner surface sections immediately upstream or downstream, or both. This configuration provides a spiral flow path for gases passing through the outer wall.

During operation, one or more cooling gases may sent through the root of the blade and into a main cooling cavity. The gas may proceed through the main cooling cavity toward the tip of the blade. At least some of the gas may enter numerous orifices in the main cavity and be passed to a plurality of first and second substantially parallel cavities. The gas may flow through the cavities along a plurality of flow paths having a generally spiral path. The spiral flow increases the rate of convection and thus increases the cooling capacity of the cooling system. The gas may be exhausted through a plurality of exhaust orifices. The exhaust orifices may be used to provide film cooling to the outer surfaces of the outer wall of the turbine blade. The exhaust orifices on the pressure side of the blade may be positioned aft of the showerhead a sufficient distance to cool the aft portions of the pressure side. Exhaust orifices may not be included proximate to the leading edge on the pressure side because film cooling is often not necessary in that location. Exhaust orifices on the suction side of the blade may be positioned upstream of a gage point to limit aerodynamic losses associated with film mixing downstream of the gage point. These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
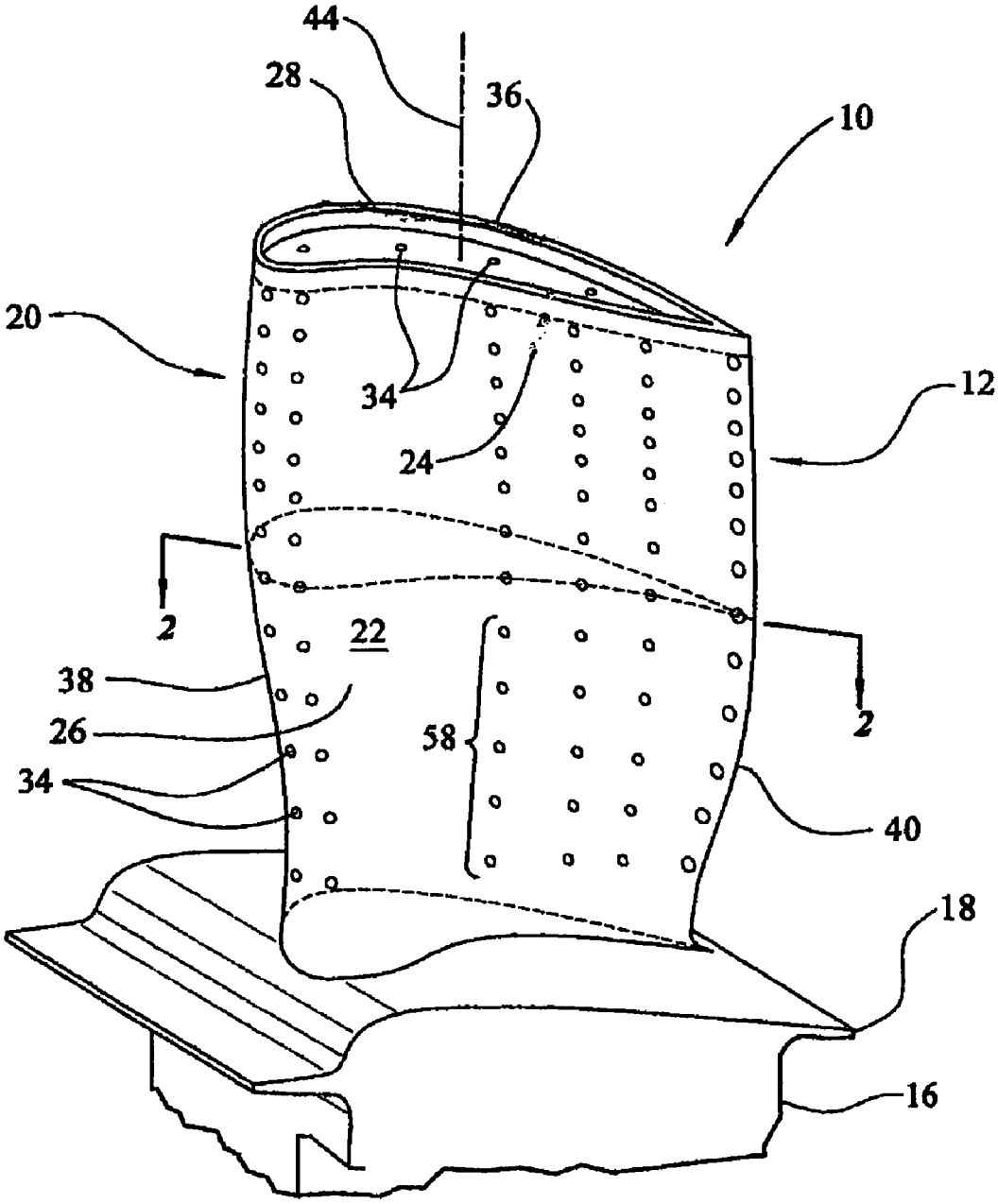
FIG. 1 is a perspective view of a turbine blade having features according to the instant invention.

As shown In FIGS. 1–5, this invention is directed to a turbine blade cooling system 10 for turbine blades 12 used in turbine engines. In particular, turbine blade cooling system 10 is directed to a cooling-system located in an outer wall 24 of the turbine blade 12 for forming a spiral flow in a cooling fluid as the fluid flows through the outer wall 24. As shown In FIG. 1 the turbine blade 12 may be formed from a root 16 having a platform 18 and a generally elongated blade 20 coupled to the root 16 at the platform 18. Blade 20 may have an outer surface 22 adapted for use, for example, in a first stage of an axial flow turbine engine. Outer surface 22 may be formed from an outer wall 24 having a generally concave shaped portion forming pressure side 26 and may have a generally convex shaped portion forming suction side 28. The blade 20 may include one or more main cavities 32 positioned in inner aspects of the blade 20 for directing one or more gases, which may include air received from a compressor (not shown), through the blade 20 and out of one or more orifices 34 in the blade 20. As shown in FIG. 1, the orifices 34 may be positioned in a tip 36, a leading edge 38, or a trailing edge 40, or any combination thereof, and have various configurations.

Figure 2:
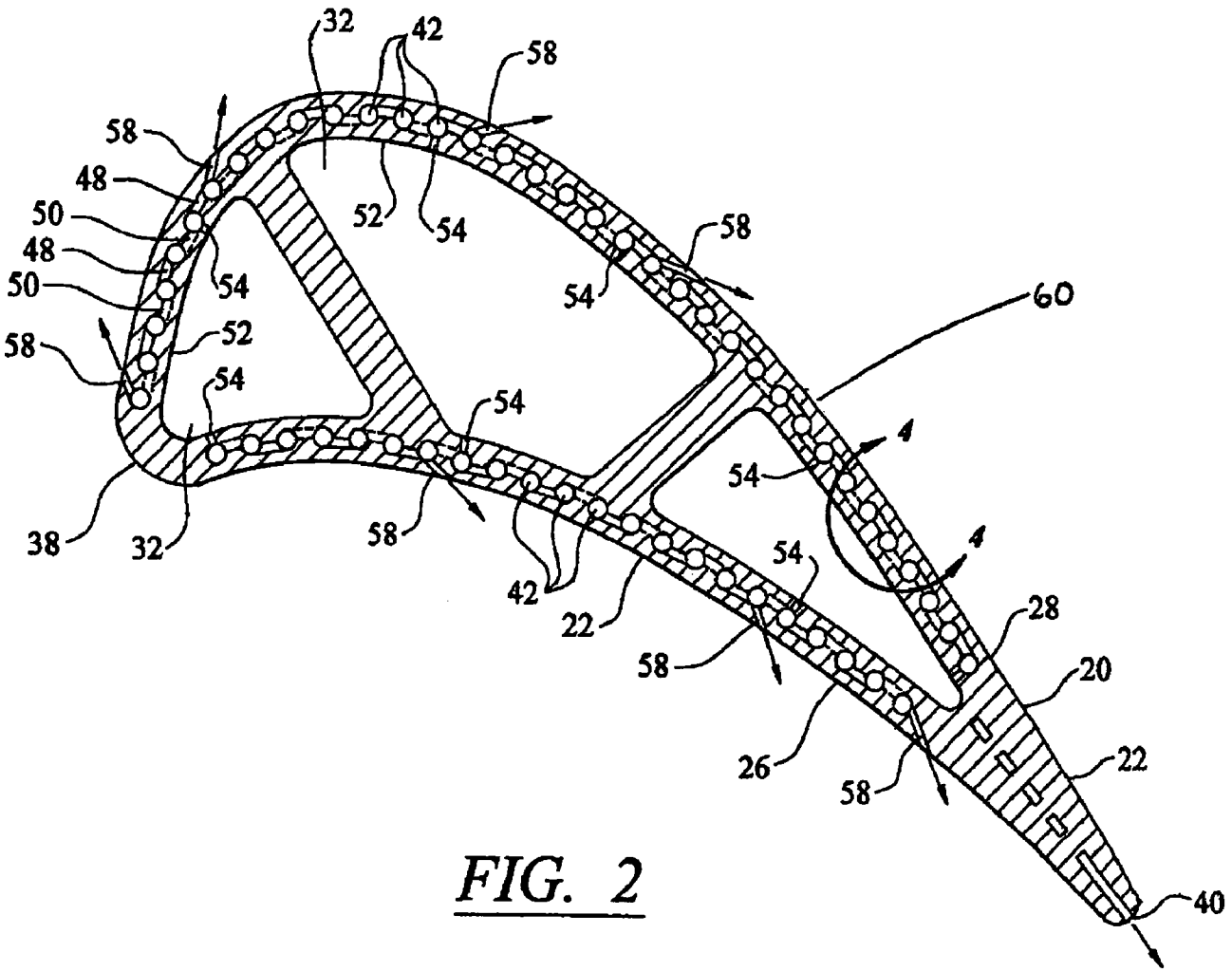
FIG. 2 is cross-sectional view of the turbine blade shown in FIG. 1 taken along line 2—2.

The main cavity 32 may be arranged in various configurations. For instance, as shown in FIG. 2, the main cavity 32 may form cooling chambers that extend through root 16 and blade 20. In particular, the main cavity 32 may extend from the tip 36 to one or more orifices (not shown) in the root 16. Alternatively, the main cavity 32 may be formed only in portions of the root 16 and the blade 20. The main cavity 32 may be configured to receive a cooling gas, such as air, from the compressor (not shown). The main cavity 32 is not limited to the configuration shown in FIG. 2, but may have other configurations as well.

Figure 4:
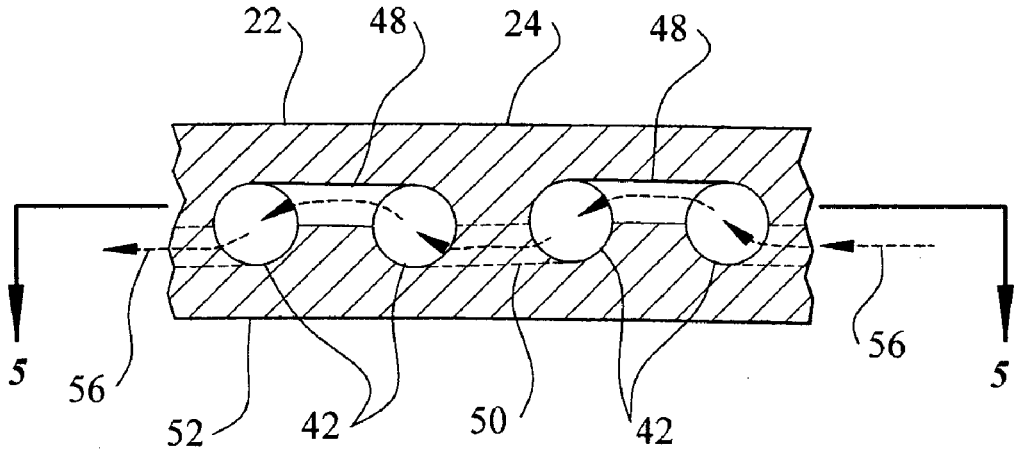
FIG. 4 is a cross-sectional view of the turbine blade shown in FIG. 2 taken at detail 4.

As previously mentioned, the outer wall 24 may include at least a portion of the turbine blade cooling system 10. In particular, the outer wall 24 may include a first plurality of substantially parallel cavities 42, as shown in FIG. 4. These cavities 42 may extend substantially parallel to the outer surface 22 of the outer wall 24. However, in alternative embodiments, the cavities 42 may be arranged in other positions relative to the outer surface 22 while remaining in the outer wall 24. Still yet, in other embodiments, the plurality of cavities 42 may be positioned at other angles relative to each other. In at least one embodiment, the plurality of parallel cavities 42 may be substantially parallel to a longitudinal axis 44 of the turbine blade 12. The plurality of cavities 42 may have an interior surface having any shape conducive for allowing gases to flow through the cavities. In at least one embodiment, one or more of the plurality of cavities 42 may have a generally cylindrical cross-section. In other embodiments, one or more of the plurality of cavities 42 may have a cross-section that is elliptical, triangular, rectangular, square, octagonal, or formed of other polygonal shapes.

The outer wall may also include a second plurality of substantially parallel cavities 46. In at least one embodiment, the second plurality of parallel cavities 46 may be positioned nonparallel to the first plurality of substantially parallel cavities 42 and may intersect the first plurality of parallel cavities 42. These cavities 46 may extend substantially parallel to the outer surface 22 of the outer wall 24. However, in alternative embodiments, the cavities 46 may be arranged in other positions relative to the outer surface 22 while remaining in the outer wall 24. Still yet, in other embodiments, the second plurality of cavities 46 may be positioned at other angles relative to each other. In at least one embodiment, the second plurality of parallel cavities 46 may be generally orthogonal to the first plurality of parallel cavities 42. The second plurality of cavities 46, like the first plurality of cavities 42, may have an interior surface having any shape conducive for allowing gases to flow through the cavities. In at least one embodiment, one or more of the second plurality of cavities 46 may have a generally cylindrical cross-section. In other embodiments, one or more of the second plurality of cavities 46 may have a cross-section that is elliptical, triangular, rectangular, square, octagonal, or formed of other polygonal shapes.

Figure 3:
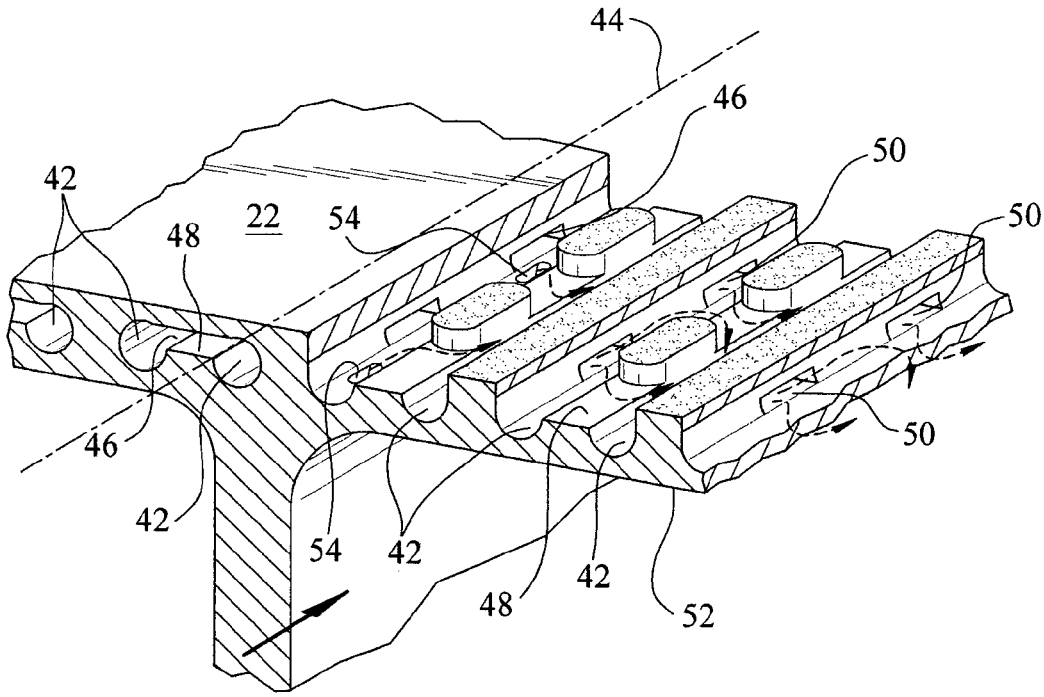
FIG. 3 is a perspective view of a portion of an outer wall of the turbine blade in a filleted view.
Figure 5:
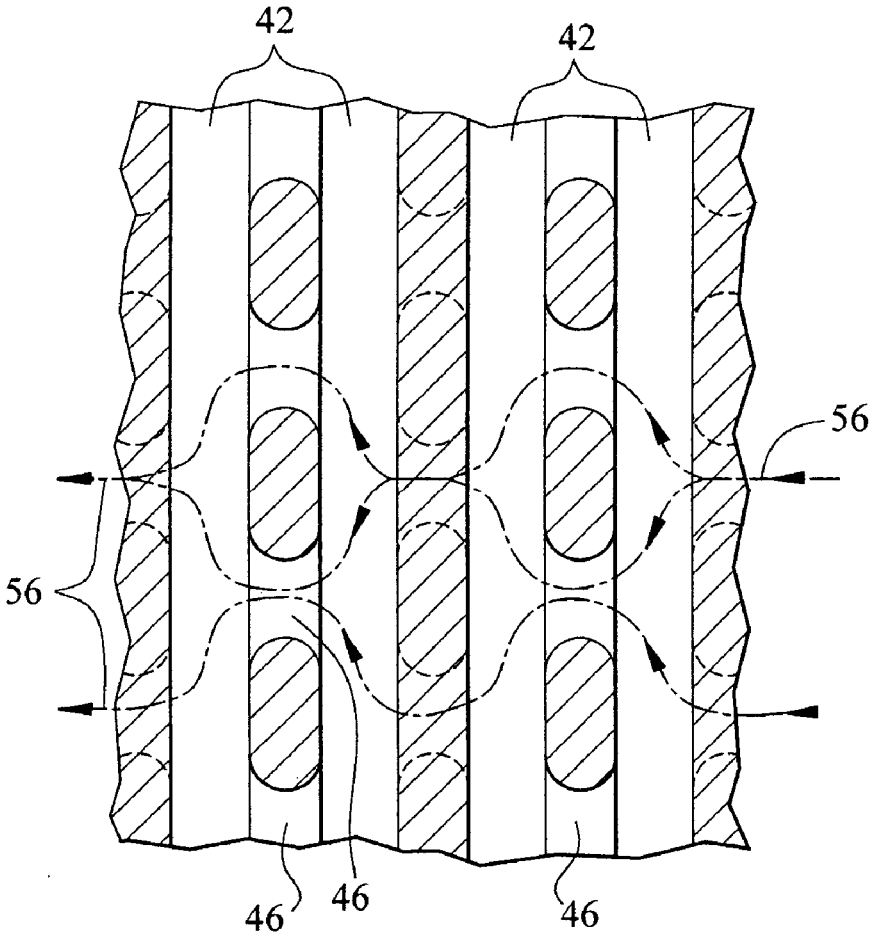
FIG. 5 is a cross-sectional view, referred to as a filleted view, of the turbine blade shown in FIGS. 1 and 4 taken along line 5—5.

In at least one embodiment, as shown in at least FIG. 3, the second plurality of cavities 46 may include at least one portion of at least one cavity 48, referred to as an outer surface section 48, intersecting at least two cavities of the first plurality of parallel cavities 42 and located proximate to the outer surface 22 of the outer wall 24. In at least one embodiment, a plurality of outer surface sections 48 may be positioned in an alternating manner between two cavities of the first plurality of cavities 42, as shown in FIG. 3. The second plurality of cavities 46 may include at least one portion of at least one cavity 50, referred to as an inner surface section 50, intersecting at least two cavities of the first plurality of cavities 42 and located proximate to an inner surface 52 of the outer wall 24. In at least one embodiment, a plurality of inner surface sections 50 may be positioned in an alternating manner between two cavities of the first plurality of cavities 42, as shown in FIG. 3. The plurality of outer surface sections 48 and the plurality of inner surface sections 50 may be positioned in an alternating configuration relative to each other, as shown in FIG. 3. Thus, an outer surface section 48 may be positioned immediately downstream or upstream, or both, relative to an inner surface section 50. In at least one embodiment, as shown in FIG. 3, the plurality of outer surface sections 48 may be offset, which may be along the longitudinal axis 44 of the blade 20, relative to the inner surface sections 50 immediately upstream or downstream, or both, as shown in FIGS. 3 and 5.

During operation, one or more gases are passed into main cavity 32 through orifices (not shown) in the root 16. The gas may or may not be received from a compressor (not shown). The gas flows through the main cavity 32 and cools various portions of the blade 20. The gas also flows from the main cavity 32 through one or more supply orifices 54 into cavities 42 or 46, or both. The supply orifices 54 may be positioned at various locations along the main cavity 42, as shown in FIG. 3. The gas may then flow through the first plurality of cavities 42 and the second plurality of cavities 46, as shown in FIGS. 3–5. As the gas flows through these cavities 42 and 46, the gas flows along a generally spiral flow path, as indicated by arrows 56. The gas passing through the cavities 42 and 46 may receive heat from the surfaces of the outer wall 24, thereby cooling the outer wall 24 of the turbine blade 12.

The gas may be exhausted from the cavities 42 and 46 through one or more exhaust orifices 58. The exhaust orifices 58 may be positioned along the length of the blade 20, as shown in FIG. 1. The exhaust orifices 58 may be positioned at regular or irregular intervals along the blade 20. In at least one embodiment, the exhaust orifices 58 may be positioned along the pressure side 26 and the suction side 28 of the blade 20. On the pressure side 26 of the blade 20, a first row of exhaust orifices 58 may be positioned at a distance from the leading edge 38 of the blade 20, as shown in FIG. 2, because surface film cooling may not be needed in the portion of the blade 20 just aft of the leading edge 38. Other exhaust orifices 58 may be positioned in one or more rows on the pressure side 26 aft of the first row of exhaust orifices 58 to provide film cooling to the remainder of the outer surface 22 on the pressure side 26 of the blade 12.

On the suction side 28 of the blade 20, the exhaust orifices 58 may be positioned in one or more rows to exhaust air from the cavities 42 and 46 in the outer wall 24 and to provide film cooling to the outer surface 22 of the outer wall 24. In at least one embodiment, a plurality of exhaust orifices 58 may be positioned in one or more rows upstream of a gage point 60, as shown in FIG. 2, to minimize aerodynamic losses associated with downstream film mixing. The gage point 60 is the location of minimum flow area between the outer surface 22 of the suction side 28 and an adjacent turbine blade, as known to those of ordinary skill in the art.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine blade, comprising:

a generally elongated blade formed from at least one outer wall and having a leading edge, a trailing edge, a pressure side, a suction side, a tip at a first end, a root coupled to the blade at an end generally opposite the first end for supporting the blade and for coupling the blade to a disc, a longitudinal axis extending from the tip to the root, and at least one cavity forming at least a portion of a cooling system in the blade;

a first plurality of substantially parallel cavities in the at least one outer wall extending substantially parallel to an outer surface of the at least one outer wall of the generally elongated blade;

a second plurality of substantially parallel cavities in the at least one outer wall positioned nonparallel to the first plurality of parallel cavities and intersecting with the first plurality of substantially parallel cavities, wherein at least one of said cavities from said second set of cavities fluidly connects a plurality of cavities from said first set of cavities;

wherein at least one cavity of the second plurality of substantially parallel cavities is positioned proximate to the outer surface of the outer wall and at least one of the second plurality of substantially parallel cavities adjacent to the at least one cavity of the second plurality of substantially parallel cavities positioned proximate to the outer surface of the outer wall is positioned proximate to an inner surface of the outer wall.

2. The turbine blade of claim 1, wherein the first plurality of substantially parallel cavities is positioned substantially parallel to the longitudinal axis of the turbine blade.

3. The turbine blade of claim 2, wherein the second plurality of substantially parallel cavities is positioned generally orthogonal to the first plurality of substantially parallel cavities.

4. The turbine blade of claim 1, wherein the second plurality of substantially parallel cavities is positioned generally orthogonal to the first plurality of substantially parallel cavities.

5. The turbine blade of claim 1, wherein the second plurality of substantially parallel cavities comprises an alternating configuration of a first cavity positioned proximate to an inner surface of the outer wall and a second cavity adjacent to the first cavity positioned proximate to an outer surface of the outer wall and the plurality of substantially parallel cavities proximate to the inner surface are offset relative to the plurality of substantially parallel cavities proximate to the outer surface positioned adjacent to the plurality of substantially parallel cavities proximate to the inner surface.

6. The turbine blade of claim 1, wherein at least one of the first plurality of substantially parallel cavities has a cylindrical cross-section.

7. The turbine blade of claim 6, wherein the first plurality of substantially parallel cavities has a cylindrical cross-section.

8. The turbine blade of claim 1, further comprising at least one exhaust orifice connected to at least one of the parallel cavities in the suction side of the outer wall upstream of a gage point.

9. The turbine blade of claim 1, further comprising a plurality of exhaust orifices connected to at least one of the parallel cavities in the suction side of the outer wall upstream of a gage point.

10. The turbine blade of claim 1, further comprising at least one exhaust orifice connected to at least one of the parallel cavities in the pressure side of the outer wall downstream of the leading edge.

11. The turbine blade of claim 1, further comprising a plurality of exhaust orifices connected to at least one of the parallel cavities in the pressure side of the outer wall downstream of the leading edge.

12. The turbine blade of claim 1, further comprising at least one supply orifice in the outer wall between the at least one cavity forming a cooling system in the blade and at least one of the first plurality of substantially parallel cavities.

13. A turbine blade, comprising:

a generally elongated blade formed from at least one outer wall and having a leading edge, a trailing edge, a pressure side, a suction side, a tip at a first end, a root coupled to the blade at an end generally opposite the first end for supporting the blade and for coupling the blade to a disc, a longitudinal axis extending from the tip to the root, and at least one cavity forming at least a portion of a cooling system in the blade;

a first plurality of substantially parallel cavities in the at least one outer wall extending substantially parallel to an outer surface of the at least one outer wall of the generally elongated blade;

a second plurality of substantially parallel cavities in the at least one outer wall positioned nonparallel to the first plurality of parallel cavities and intersecting with the first plurality of substantially parallel cavities, wherein at least one of said cavities from said second set of cavities fluidly connects a plurality of cavities from said first set of cavities;

wherein the second plurality of substantially parallel cavities comprises an alternating configuration of a first cavity positioned proximate to an inner surface of the outer wall and a second cavity adjacent to the first cavity positioned proximate to an outer surface of the outer wall.

14. The turbine blade of claim 13, wherein the first plurality of substantially parallel cavities is positioned substantially parallel to the longitudinal axis of the turbine blade.

15. The turbine blade of claim 14, wherein the second plurality of substantially parallel cavities is positioned generally orthogonal to the first plurality of substantially parallel cavities.

16. The turbine blade of claim 13, wherein the second plurality of substantially parallel cavities is positioned generally orthogonal to the first plurality of substantially parallel cavities.

17. The turbine blade of claim 13, wherein at least one of the first plurality of substantially parallel cavities has a cylindrical cross-section.

18. The turbine blade of claim 13, further comprising at least one exhaust orifice connected to at least one of the parallel cavities in the suction side of the outer wall upstream of a gage point.

19. The turbine blade of claim 13, further comprising at least one exhaust orifice connected to at least one of the parallel cavities in the pressure side of the outer wall downstream of the leading edge.

20. The turbine blade of claim 13, further comprising at least one supply orifice in the outer wall between the at least one cavity forming a cooling system in the blade and at least one of the first plurality of substantially parallel cavities.

21. A turbine blade, comprising:

a generally elongated blade formed from at least one outer wall and having a leading edge, a trailing edge, a pressure side, a suction side, a tip at a first end, a root coupled to the blade at an end generally opposite the first end for supporting the blade and for coupling the blade to a disc, a longitudinal axis extending from the tip to the root, and at least one cavity forming at least a portion of a cooling system in the blade;

a first plurality of substantially parallel cavities in the at least one outer wall extending substantially parallel to an outer surface of the at least one outer wall of the generally elongated blade, wherein at least one of the first plurality of substantially parallel cavities has a cylindrical cross-section;

a second plurality of substantially parallel cavities in the at least one outer wall positioned nonparallel to the first plurality of parallel cavities and intersecting with the first plurality of substantially parallel cavities;

wherein at least one cavity of the second plurality of substantially parallel cavities is positioned proximate to the outer surface of the outer wall and at least one of the second plurality of substantially parallel cavities adjacent to the at least one cavity of second plurality of substantially parallel cavities positioned proximate to the outer surface of the outer wall is positioned proximate to an inner surface of the outer wall.

* * * * *